US006213424B1

(12) United States Patent
Helfer-Grand

(10) Patent No.: US 6,213,424 B1
(45) Date of Patent: Apr. 10, 2001

(54) TOWELETTE DISPENSER APPARATUS

(76) Inventor: Beverly Helfer-Grand, 26 E. Williston Ave., East Willison, NY (US) 11596

( * ) Notice: Subject to any disclaimer, the term of this patent is extended or adjusted under 35 U.S.C. 154(b) by 0 days.

(21) Appl. No.: 09/187,493

(22) Filed: Nov. 6, 1998

Related U.S. Application Data

(60) Provisional application No. 60/064,810, filed on Nov. 7, 1997.

(51) Int. Cl.[7] ..... B65H 19/16; B67D 1/07

(52) U.S. Cl. ..... 242/564.1; 242/563; 222/192

(58) Field of Search ..... 242/563, 563.2, 242/564.1, 564.4; 222/192, 146.5; 239/239, 289, 135, 99; 219/214, 386, 521

(56) References Cited

U.S. PATENT DOCUMENTS

| | | | |
|---|---|---|---|
| 345,052 | 6/1886 | Harrison . | |
| 2,342,048 | 2/1944 | Halfin . | |
| 2,560,061 | 7/1951 | Agamaite, Jr. . | |
| 2,806,591 | 9/1957 | Appleton . | |
| 2,886,226 | 5/1959 | Batlas et al. . | |
| 3,192,008 | 6/1965 | Dwyer . | |
| 3,363,959 | 1/1968 | Sames . | |
| 3,397,817 | 8/1968 | Smith . | |
| 3,600,049 | 8/1971 | Bastian . | |
| 3,667,825 | 6/1972 | Pagel . | |
| 4,004,711 | 1/1977 | Ravich . | |
| 4,119,255 * | 10/1978 | D'Angelo | 242/563 X |
| 4,274,551 | 6/1981 | Hicks . | |
| 4,473,430 * | 9/1984 | Voltmer et al. | 242/563 X |
| 4,495,402 | 1/1985 | Burdick et al. . | |
| 4,690,344 * | 9/1987 | Yokota | 242/563 X |
| 4,694,973 | 9/1987 | Rose et al. . | |
| 4,890,205 | 12/1989 | Shaffer . | |
| 5,312,021 * | 5/1994 | Nelson | 222/192 X |
| 5,458,261 | 10/1995 | Veltman . | |
| 5,482,183 | 1/1996 | Beal et al. . | |
| 5,660,636 * | 8/1997 | Shangold et al. | 242/564.4 X |
| 5,691,919 * | 11/1997 | Gemmell et al. | 242/563 X |

* cited by examiner

*Primary Examiner*—Donald P. Walsh
*Assistant Examiner*—William A. Rivera
(74) *Attorney, Agent, or Firm*—Kerry S Culpepper

(57) ABSTRACT

A portable dispenser apparatus that dispenses pre-moistened towelettes from a web. The dispenser includes a housing presenting a towelette dispensing opening and a storage compartment adapted to support the web of towelettes in a roll. A dispensing assembly is provided for drawing the end-most towelette from the web and dispensing it through the dispensing opening when a dispensing actuator is operated. The actuator activates the dispensing assembly to dispense a single towelette from the web, and returns the remaining web to the roll subsequent to removal of the end-most towelette by the user so that the next towelette of the web remains moist until subsequently dispensed. A manually operated web-fed dispenser and a travel dispenser are also provided, as is a moistening composition for use on the towelettes.

15 Claims, 2 Drawing Sheets

TOWELETTE DISPENSER APPARATUS

CROSS-REFERENCE TO RELATED APPLICATIONS

The present application is related to and claims the benefit of U.S. Provisional Application Ser. No. 60/064,810, filed Nov. 7, 1997 now expired.

STATEMENT REGARDING FEDERALLY SPONSORED RESEARCH OR DEVELOPMENT

"Not Applicable".

BACKGROUND OF THE INVENTION

The present application relates generally to sheet or web dispensers, and more particularly to a dispenser apparatus for use in dispensing antiseptic, pre-moistened towelettes that are stored in either web or sheet form.

Infectious diseases remain the leading cause of death, world-wide, and the third leading cause of death in the U.S. Voluminous authoritative research, conducted during the last 150 years, by an array of pertinent disciplines, agencies and industries concur that frequent hand washing is the single-most reliable means for preventing the spread of infectious diseases.

Unfortunately, voluminous authoritative research also continues to reveal an abhorrent failure in compliance with this seemingly benign edict. Among the most intensely studied contexts—the health care, child care, elder-care, and food service industries, workers have been found to wash their hands in approximately 30% of required instances. Further, studies indicate that 30% of all food poisoning incidents recorded occur in the home, and at least 70% of these are hand-transmitted, person-to-person, fecal-to-oral incidents.

Particularly during the last two decades, the U.S. has been confronted with the following, ongoing, conditions: (1) growing numbers of emergent and re-emergent pathogens which are attacking with greater "stealth" force, and with unprecedented unpredictability; (2) increasing numbers of multi-drug resistant pathogens; (3) swelling populations of vulnerable immuno-compromised patients; (4) indiscriminate use of antibiotics, contributing to their growing impotence; (5) high-load pathogen sites which defy familiar socioeconomic boundaries; (6) an estimated 70% of transmission of pathogenic microbes via hand-transmission, primarily person-to-person, fecal-to-oral route; (7) the dissolution of our own health care infrastructure, such that it is an acknowledged contributor to the emergence and re-emergence of multi-drug resistant pathogens; and (8) globalization of infectious diseases previously limited by geographic boundaries.

Prevention of illness, personal responsibility for same, and the concept of wellness have, until recently, lingered about the fringes of health care. Our longstanding health care paradigm has been the medical model. Only the physician knows how to treat illness. Often, treatment addresses symptoms rather than cause. Generally, a "piece" of a patient is treated, without regard for systemic interactive physiology. However, a paradigm shift has been occurring. For example, more Americans have used alterative or complementary medicine in recent years than was previously the case. As such, it appears that Americans are turning to more natural, holistic healing modalities. In reality, at this time, there are no other viable health care alternatives.

BRIEF SUMMARY OF THE INVENTION

It is an object of the present invention to provide a dispensing apparatus that renders frequent hand cleansing feasible, and that motivates sustained changes in hand washing behavior via integral operant and classical conditioning strategies built into actual products.

Most vital among its multiple uses, the dispensing apparatus of the present invention makes frequent and effective hand washing realistic and practical. In this capacity, the inventive apparatus provides the tools for strategic intervention to "break the chain of contagion" of hand-transmitted infectious diseases. This means, for example, that many food-borne pathogens, which we carry on our own contaminated hands, will be killed before exposure to the bulnerable mucosal membranes of the mouth, nose, and eyes. Hand transmission is one of the major forms of contagion of infectious diseases. In the case of eating, hand transmitted pathogens easily become "food-borne" pathogens. In this common situation, we literally "self-inoculate."

One of the paramount obstacles to frequent hand washing, using traditional methods, is that they are time and labor intensive. Consequently, hands are far too seldom washed, at all. In addition, incomplete de-contamination, or virtually instantaneous re-contamination, for example, by touching bathroom door hardware while exiting, are common using traditional hand washing methods.

In order to accommodate today's fast-paced and demanding lifestyles, the dispensing apparatus of the present invention provides convenient, quick and easy access to all materials necessary for pleasant, broadly germicidal, fast, effective hand cleansing. The inventive apparatus also protects against both incomplete hand cleansing, and common re-contamination risks.

The inventive apparatus is a compact, durable, safe, reliable, portable, multi-purpose anti-microbial weapon. It dispenses, either at room temperature or warmed, individual, broadly germicidal, biodegradable, sturdy yet soft, soothing, moisturizing and healing, flushable pre-moistened towelettes for sanitary/antiseptic cleaning of skin on hands, face and other parts of the human anatomy as needed. In addition to dispensing pre-moistened, perforated towelettes, the inventive apparatus optionally includes a hand drying assembly, a sanitary disposal compartment for used towelettes and a sensor adopted for use with badges for permitting verification of use of the apparatus by users wearing such badges. As a result, the apparatus is universally adaptable for domestic, business, industrial and institutional use.

The inventive dispensing apparatus differs from traditional hand-washing methods in many significant wants, including the following: (1) Hand cleaning is completed significantly faster; (2) All necessary "ingredients" for antiseptic, moisturizing, healing hand washing are conveniently available in a compact, self-contained unit; (3) Hand cleansing evolves from being a burden, to being easy and pleasurable and habitual; (4) An inclusive system of sanitary disposal of used towelettes prevents unwitting contamination of other sites or persons; (5) Cost in human energy usage regarding self and hand cleansing of children is greatly reduced; (6) Children can more reliably be taught autonomy in disease prevention for self/wellness because the apparatus is easy to use and feels good, providing a positive reinforcement effect; (7) Children and adults are repeatedly influenced to remain aware that their personal hygiene can have a most serious impact on the well-being of others; (9) A great deal of the enormous costs of infectious diseases can be put to far more constructive use, while human suffering and needless loss of lives can be significantly diminished; and (10) An apparatus is provided that is adaptable for use globally.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
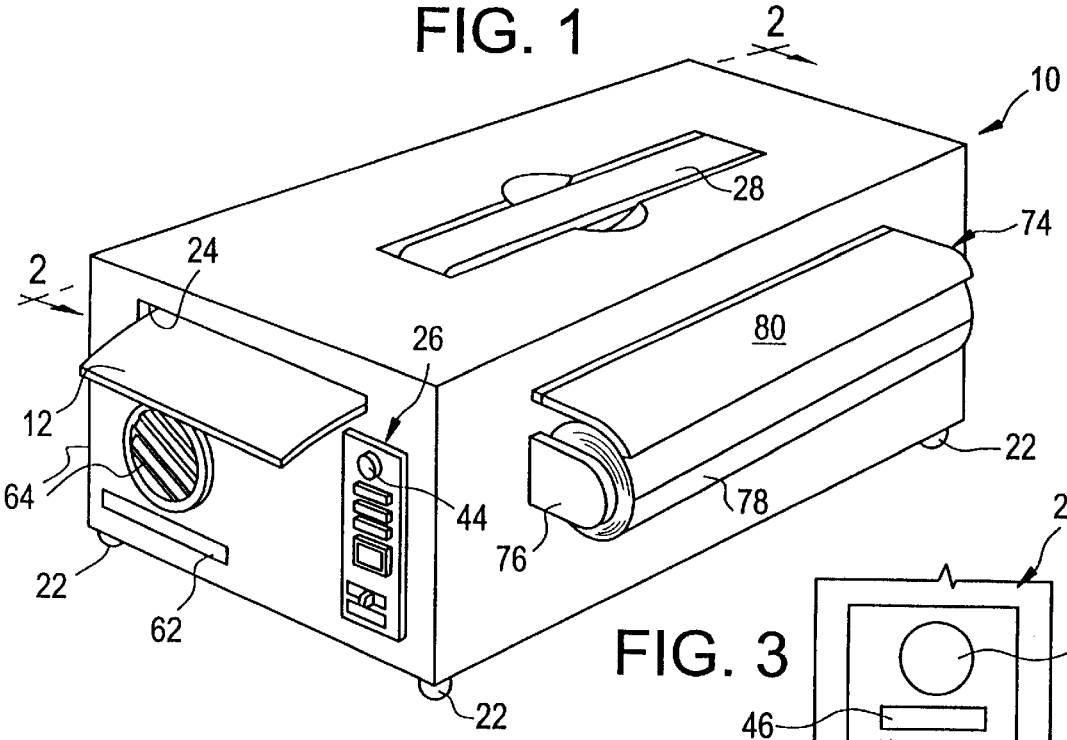
FIG. 1 is a perspective view of a first dispensing apparatus constructed in accordance with the preferred embodiment.
Figure 2:
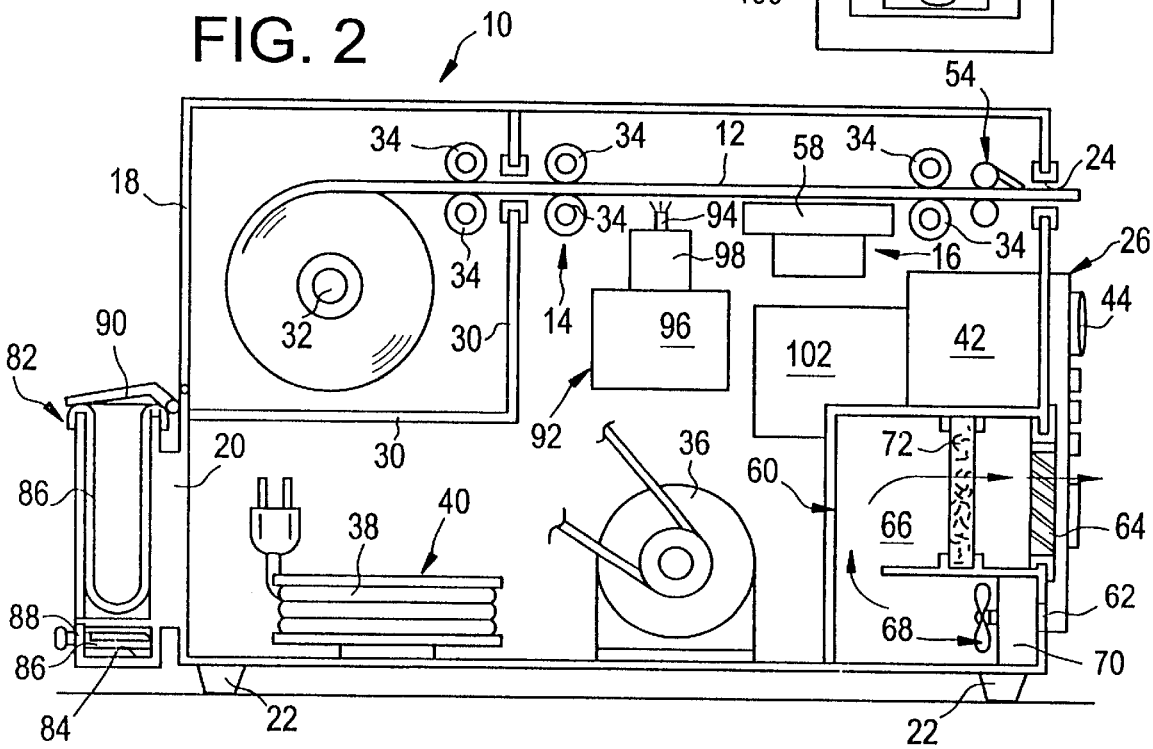
FIG. 2 is a schematic view of the first apparatus, illustrating various components forming a part thereof.

A dispenser apparatus constructed in accordance with the preferred embodiment of the present invention is illustrated in FIG. 1, and broadly includes a housing 10 in which a web 12 of pre-moistened towelettes is supported, a towelette dispensing assembly 14, shown in FIG. 2, for dispensing the towelettes one-by-one to a user upon demand, and a warming assembly 16 for warming the towelettes as they are dispensed.

The housing 10 is of a size and shape that permits the apparatus to be mounted in any of a number of different positions, such as on a table top, under a counter, or on a wall, and any conventional mounting structure can be employed to secure the housing in any of these orientations. The housing is formed of a heat insulative material such as a synthetic resin or the like, and generally includes a bottom wall, four side walls, and a top wall, and at least some of the walls are provided with hinged panels 18, 20 that may be opened to expose the interior of the housing to allow access to the various components supported therein. Preferably, the panels are latched shut, and the latches used are child-proof to prevent young children from tampering with the apparatus.

The bottom wall of the housing defines a base of the apparatus, and includes a plurality of feet 22 on which the apparatus rests when set on a support surface. Preferably rubber shoes are fitted on the feet to stabilize the apparatus during use.

As shown in FIG. 1, the front wall of the dispensing apparatus has an opening 24 through which the pre-moistened towelettes are dispensed, and a control panel 26 is supported on the front wall to allow easy access thereto by a user. In addition, one or more apertures may be formed in the front and/or side walls for receipt of one or more hand dryer vents, as described below.

An ergonomic handle 28 is provided on the top wall of the housing for facilitating secure and safe transport of the apparatus between use locations. Preferably, the handle is retractable from a recess formed in the top wall such that the handle does not protrude from the recess unless retracted for use, and it may be impregnated with triclosan or other material for reducing exposure of a user to infection.

Returning to FIG. 2, the pre-moistened towelettes are stored as a web initially wound in a roll, and include a substrate impregnated with a suitable moistening composition. The substrate is formed of a fibrous material such as paper fiber, cotton fiber or the like, and is composed as a recyclable or biodegradable product that is sturdy, soft, absorbent, and flushable. The moistening composition is preferably a lotion including an antiseptic solution and any of several other ingredients for preventing and treating dryness of the user's skin. Although several conventional antiseptic agents are available for use in the moistening composition, many experience limitations such as host toxicity, inactivation by organic matter, narrow spectrum of anti-microbial action, poor residual activity or, most critically, drying and irritations of the skin with frequent use. This last limitation is a major impediment to frequent hand cleansing, particularly in high-use settings such as in the health care field.

Preferably, the active ingredients used in the towelette of the present invention includes Triclosan, which reliably lyses bacterial membranes. In addition, the composition includes an array of known botanical compounds which demonstrate, in addition to anti-bacterial properties, anti-fungal, anti-parasitic, anti-protozoan, and anti-larval activity without host toxicity. Botanical antiseptic compounds show enhanced anti-microbial activity in the presence of organic matter. Plant chemical also tend to act synergistically, thereby adding efficiency without adding cost.

The moistening compound also preferably includes various known herbs and essential oils which enhance skin integrity, health and appearance. For example, the composition may include vitamins, minerals and proteins that nourish skin cells, act as an anti-oxidant, stimulate circulation, fuel cellular regeneration, and soften, sooth and moisturize the skin, preventing and treating dryness, irritation, chapping, and cracked or infected skin. Such herbs and oils also may be selected for use in the composition to function as an astringent agent which aids the healing process by contracting tissue and limiting fluid loss, or to promote healing as they soothe and soften. Thus, the antiseptic cleansing lotion that makes up the composition includes a select group of broadly germicidal, soothing, healing and moisturizing botanical ingredients. In addition, the composition should be chosen to dry quickly, without residue, so that it leaves the skin refreshed, hydrated, nourished and protected, regardless of the frequency of use. Because aroma also influences mood, providing a positive reenforcement to the user of the towelettes dispensed by the apparatus, the aromatic qualities of the moisturizing composition used in the towelettes are also important, and are chosen to provide a soothing, refreshing and revitalizing sense to the user of the towelettes, encouraging repeated use.

The towelette support compartment of the apparatus can be located anywhere within the housing, and broadly includes a plurality of walls 20, 30 that enclose the compartment and prevent the towelettes from drying out during long storage periods, and a spindle 32 or the like for supporting the towelette roll. One of the walls of the compartment is defined by one of the hinged panels 20 of the housing such that the compartment is accessible for loading of a fresh roll of towelettes through the panel. The interior walls 30 of the compartment are preferably radiant barriers formed of a material that is resistant to heat such that any heat generated by the other components of the apparatus is prevented from being transferred to the towelettes. Such heating of the towelette roll would evaporate the moistening composition prior to use of the towelettes, and would also potentially degrade the potency of any plant compounds contained in the composition.

The towelette dispensing assembly 14 functions to convey the web 12 of towelettes from the roll to the dispensing opening 24 one towelette at a time, and to dispense each towelette so that the user can simply grasp the towelette and remove it for use. The dispensing assembly broadly includes a series of pinch roller pairs 34 for gripping the end towelette and guiding it from the roll to the dispensing opening. The pinch roller pairs are disposed along the desired travel path of the towelettes through the housing, and each pair defines a nip through which the towelettes are fed. The pinch rollers are also operable to return any unused towelettes to the storage compartment after a dispensing operation is completed. This later function of the pinch rollers allows the unused portion of the web to remain in the storage compartment, preventing drying of the leading edge of the next towelette to be dispensed.

A motor 36 is provided for driving bi-directional rotation of the pinch rollers 34 to both dispense the web and to return the unused portion thereof to the storage compartment. The motor 36 can be of any conventional type, depending on the environment for which the apparatus is constructed. For example, an AC motor would be provided for an apparatus adapted for use in a home or business, whereas a DC or battery-operated motor could be provided in a portable embodiment, such as one designed for use outdoors or in an automobile.

In the illustrated embodiment, an AC motor is shown, and conventional transmission belts or gears are provided in the housing for transmitting the rotary output from the motor to the various pinch rollers of the assembly. A power cord 38 is provided for supplying power to the motor. The power cord is preferably stored on a retractable spool 40 supported within the housing so that when a length of the cord is not in use, it can be wound on the spool for storage. The spool 40 is spring biased to wind up any loose cord such that only the necessary length of cord is exposed at any given time. Alternately, a pair of oppositely facing hooks may be provided on the housing of the apparatus for supporting the cord when it is not in use.

An electric circuit is provided for controlling operation of the motor 36 to drive the pinch rollers in one direction or the other to either dispense a towelette or return the remaining portion of the web to the storage compartment subsequent to a dispensing operation. The circuit includes relays and/or a controller 42 that are responsive to the several switches provided on the control panel 26 on the front of the housing.

Figure 3:
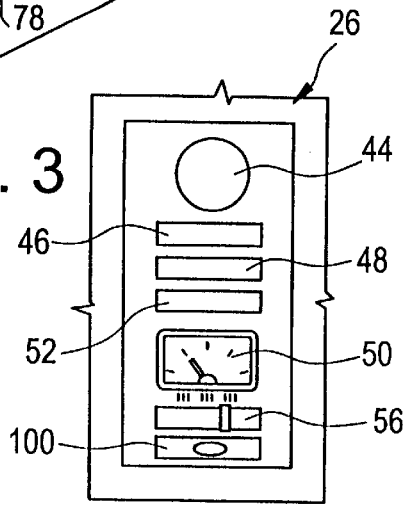
FIG. 3 is an elevational view of a control panel forming a part of the first apparatus.

As shown in FIG. 3, the control panel 26 includes an activation switch 44, a power on/off switch 46, a warmer on/off switch 48, and an indicator 50 for indicating the number of towelettes remaining in the storage compartment at any given time. In addition, if a hand dryer is provided on the apparatus, as described below, a hand dryer on/off switch 52 is provided on the panel for controlling operation thereof.

As shown in FIG. 2, the activation switch 44 is located at an easy to reach location on the housing so that a user can depress the switch with a single hand or elbow without significant effort. Alternately, a separate switch assembly may be provided remote from the control panel such that the switch can be placed on the floor adjacent the apparatus and actuated by a user's foot or elbow. Regardless of its position relative to the housing, the switch 44 is operable to momentarily activate the relays and/or controller 42 so that the motor 36 cycles through a single dispensing operation during which the motor first drives the pinch rollers 34 in the first direction until a single towelette is delivered to the dispenser opening, and then, after the towelette has been removed by the user, drives the pinch rollers in the opposite direction to return the remaining web to the storage compartment. Once this single dispensing cycle is completed, the circuit is de-energized until a subsequent activation.

The control circuit of the apparatus includes a sensor 54 located at or near the dispensing opening for detecting when the dispensed towelette has been removed by the user. The signal generated by this sensor 54 provides the control input to the relays and/or controller 42 to reverse the direction of the motor to return the remaining web to the storage compartment.

As shown in FIG. 3, it is possible to provide a control switch 56 which permits a user to select a desired number of towelettes to be dispensed in a single dispensing operation. For example, the switch may have multiple positions to allow the user to select two, three or more towelettes such that when the activation switch 44 is depressed, the circuit is energized to sequentially dispense a like number of towelettes, again one-by-one. As shown in FIG. 2, as each of the towelettes is dispensed, the sensor 54 detects removal thereof from the apparatus, triggering the subsequent dispensing of the next towelette. As such, the web 12 is not returned to the storage compartment until the selected number of towelettes are dispensed.

Still referring to FIG. 2, the warming assembly 16 is disposed along the dispensing path of the towelettes, and functions to warm each towelette to an elevated temperature relative to the user's body temperature so that the towelette is warm to the touch when drawn from the apparatus. As such, the dispensed towelette creates a positive psychophysiological effect on the user that encourages repeated use of the apparatus. Likewise, the warmed towelettes reduce adverse reactions from infants as compared to the use of "cold" towelettes.

Although the towelette must be warm to the user for a period of time after being withdrawn from the apparatus, it must not be too hot. In order to achieve such warming, the warming assembly includes a warming element 58 such as a lamp, a resistance heating element, or the like, and energization of the heating element is controlled, either by limiting the time of operation or the temperature of the element, such that the towelette is warmed but not heated above a safe temperature. In addition, the heating element can be used to dry and disinfect the warming compartment of the housing. Examples of lamps suitable for use as the heating element include incandescent, halogen or UV lamps. However, any type of element capable of transferring heat to or generating heat in the towelettes is suitable.

One of the interior walls 30 of the storage compartment includes a gasketed outlet aperture through which the towelette web passes during dispensing. The aperture is located upstream of the warming assembly 16 and is preferably spaced from the dispensing opening of the housing by a distance equal to the length of a single towelette. As such, the outlet aperture facilitates separation of each towelette from the web during dispensing, and permits the remaining web to be retained in the storage compartment free of any contamination that might otherwise occur during passage through the warming assembly.

The housing of the apparatus includes a second compartment separate from the storage compartment, and the second compartment can be used either as an additional storage compartment for towelettes prior to use, or as a housing for a hand drying assembly 60. If the hand drying assembly 60 is employed, it is powered by the electrical circuit of the apparatus, and the on/off switch 52 on the control panel activates the assembly for a hand drying operation.

The assembly 60 includes an inlet vent 62, an outlet vent 64, a passage 66 connecting the inlet and outlet vents together, a fan 68 for drawing air in the inlet and forcing it from the outlet, and a heating element 70 for warming the air as it travels through the passage. A filter 72 is also provided for filtering the air before it is discharged from the outlet vent. Grills and/or louvers are provided on the vents 62, 64 for safety and for permitting warm air to be discharged in any selected direction, and two or more outlet vents can be connected to the passage to allow multi-directional air discharge, if desired. If the second compartment is not used for receipt of the hand drying assembly, a hinged panel door is fitted over the exterior opening presented by the compartment in the housing. This door provides access to the second compartment so that towelettes can be stored therein until needed.

Regardless of whether the hand drying assembly 60 is employed in the apparatus, a paper towel support assembly 74 is preferably included to provide ready access to the user of paper towels that can be used to dry the user's hands after the user has used one of the pre-moistened towelettes. Paper towels provide the most reliable sanitary method of drying a user's hands because drying is accomplished so quickly and completely. In addition, by providing paper towels in proximity to the dispenser apparatus, the paper towels can be used as a physical shield when touching high pathogen-load sites such as bathroom faucets, door handles, etc.

The paper towel support assembly 74 can be conventional, including a base and a pair of hinged end walls 76 that present a pair of longitudinally spaced hubs on which a roll of paper towels 78 are received. The assembly 74 is preferably screwed to any selected one of the walls of the housing so as to be disposed in easy reach of a user. However, it could alternately be formed in one of the walls 76 such that the end walls are retractable from recesses in the housing wall. As such, when the assembly 74 is not in use, it does not protrude from the housing. A curved cover 80 is provided above the paper towel holder, and is operable to stabilize the removal of paper towels from the roll. Specifically, the cover 80 applies a radial force on the roll that resists unwinding thereof. As such, the roll is prevented from unwinding more than desired, and it is easier to tear the paper towel from the roll than would otherwise be the case.

A two-part sanitary disposal assembly 82 is mounted on the housing 10, and provides a simple, contamination-free and reliable system for disposing of used towelettes. The primary function of the disposal assembly is to prevent unwitting pathogen transmission by careless disposal of used towelettes. The assembly 82 includes a rear wall that is spaced from the panel, but connected thereto by suitable fasteners, a pair of side walls, and a front wall. A bottom wall is also provided on the assembly as is an interior wall that is spaced from the bottom wall to define a storage compartment 84 for unused disposal bags 86. The front wall of the assembly is connected to a hinged panel 88 between the bottom and interior walls for providing access to the compartment so that it can be filled with bags, and a slot or opening can be provided in the panel to allow removal of the bags one-by-one. The entire assembly is easily cleaned through the use of one of the towelettes.

The rear wall of the assembly is spaced from the housing so that the upper edge of the disposal assembly presents a circumferential lip from which one of the bags 86 can be suspended in the disposal compartment. The lip is preferably lined with an adhesive material that aids adhesion of the bag to the lip while permitting removal of the bag for emptying. A hinged cover 90 is also provided for covering the assembly and the top end of the bag and includes an easily accessible edge or handle that permits one-handed disposal of used towelettes. If desired, the disposal assembly could be provided separately from the apparatus. However, it is desirable to provide a sanitary means for disposing of used towelettes. As such, some type of disposal system should be used in proximity to the apparatus.

In order for the us er to operate the apparatus, he or she need only depress the button 44, activating the dispensing assembly 14 to convey the end-most towelette of the web 12 from the storage compartment to the dispensing opening 24. Depression of the button 44 energizes the motor 36 to turn in a first direction, transmitting driving force to the pinch rollers 34 to feed the web toward the dispensing opening 24. If the on/off switch 48 for the warming assembly is in the "on" position, the warming assembly 16 is automatically energized upon activation of the switch, and operates to warm the end-most towelette of the web as it is conveyed toward the dispensing aperture. If the switch 48 is in the "off" position, the warming assembly does not operate, and the towelette dispensed is at the ambient temperature of the roll.

The motor 36 drives the pinch rollers 34 in the first direction a predetermined distance so that the towelette is conveyed partially through the dispensing opening, e.g. with the leading edge of the towelette protruding from the opening 24 about 1–2 inches. Thereafter, the motor stops, awaiting receipt of a signal from the sensor 54 that the towelette has been withdrawn from the aperture by the user. The sensor 54 can include an optical sensor or a contact switch that closes in the absence of a towelette in aperture, and generates a control signal upon removal of the towelette that is used to energize the motor to rotate the pinch rollers in the second direction to return the remaining web of towelettes to the storage compartment. As such, the web 12 is protected against drying out should the apparatus sit idle for some time.

The towelette is used to cleanse the hands, face, etc. of the user, and is discarded by lifting the lid of the disposal assembly 82 and depositing the used towelette in the bag 86. Likewise, the towelette may be used to clean and disinfect items like telephones, cups, high-chair trays, food containers, and the like, and can be used between the user's hand and a door handle as a shield against infection. After use is complete, the user activates the hand drying assembly 60 or takes a paper towel from the roll 78, and dries his or her hands. If a paper towel is used, it can later be deposited in a convenient trash container or used as a shield by the user as the user handles a faucet or other potentially unsanitary hardware.

In accordance with an alternate embodiment of the invention, the apparatus could be used to dispense towelettes that are stored dry, and are pre-moistened when they are dispensed. In accordance with this embodiment, a wetting assembly 92, shown in broken lines in FIG. 2, is provided in the housing which includes a wetting mechanism 94 and a reservoir 96 for storing the moistening composition. The wetting mechanism 94 can include a sprayer or the like, and is connected to a pump 98 that draws the moistening composition from the reservoir and applies it to the end-most towelette as the towelette is conveyed toward the aperture. Preferably, the wetting mechanism 94 is located upstream of the warming assembly 16 relative to the path followed by the towelette web so that the moistening composition is warmed with the towelette prior to dispensing. However, it would also be possible to combine the wetting and warming operations by warming the moistening composition prior to application to the towelettes. As such, the composition would warm the towelette, and use of a separate warming assembly would be obviated.

Another optional construction of the apparatus includes the use of a means for sensing usage of the apparatus so that an employer or parent could monitor how often an employee or child used towelettes. In order to achieve such monitoring, a badge is provided which is worn by the user, and a sensor 100 is mounted on or near the apparatus which is capable of detecting the presence of the badge in the vicinity of the apparatus at the time of activation of the button. By sensing for a badge each time the button 44 is depressed, and by recording or saving such information, it is possible to monitor how often a person wearing a particular badge has activated the apparatus. Such information can be used to reward responsible hand cleansing, and to encourage infrequent users to improve their habits.

Another optional feature of the apparatus designed to provide a positive reinforcement to young users thereof includes a playback device 102, such as a audio or video player, that provides verbal instructions or feedback to anyone activating the button. The use of this type of reinforcing means, along with the use of a color-coded or icon-based control panel simplifies use thereof, and encourages young people to increase the frequency of use of the apparatus.

Figure 4:
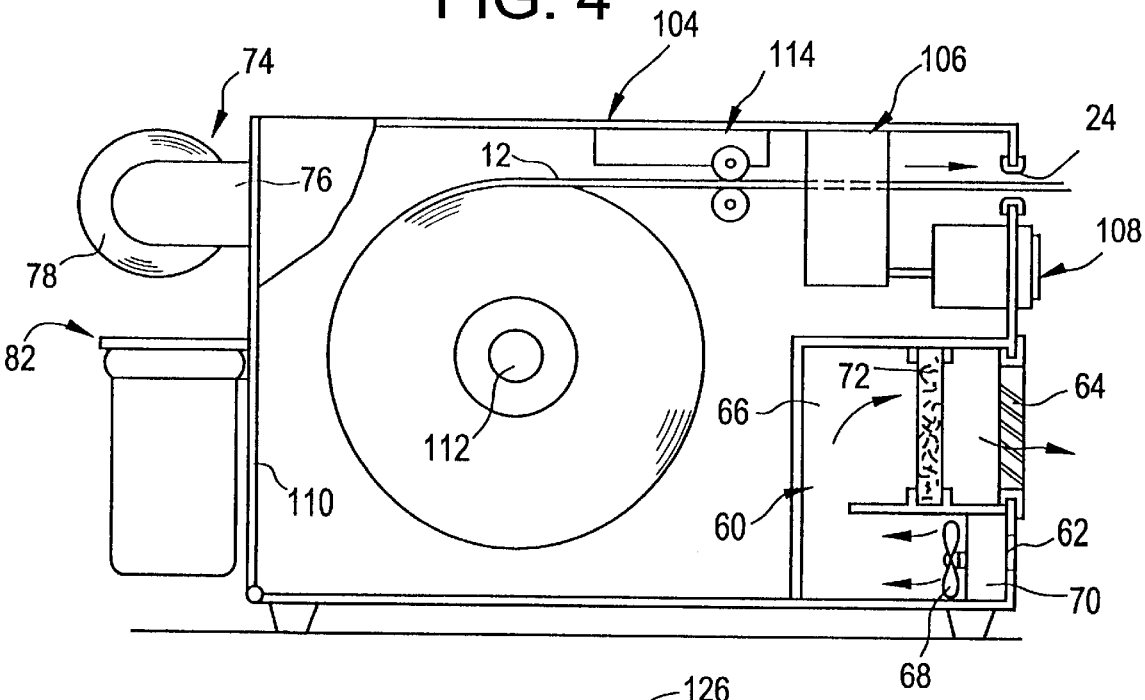
FIG. 4 is a schematic view of a second dispensing apparatus constructed in accordance with the preferred embodiment.

Another embodiment of the present invention is illustrated in FIG. 4, and broadly includes a portable housing 104 in which a web 12 of pre-moistened towelettes is supported, a towelette dispensing assembly 106 for dispensing the towelettes one-by-one to a user upon demand, and a verification assembly 108 for sensing usage of the apparatus so that an employer can monitor how often employees uses the apparatus.

The housing 104 is of a size and shape that permits the apparatus to be mounted in any of a number of different positions, such as on a table top, under a counter, or on a wall, and any conventional mounting structure can be employed to secure the housing in any of these orientations. The housing is formed of a synthetic resin material or the like, and generally includes a bottom wall, four side walls, and a top wall, and at least one of the walls is provided with a hinged panel 110 that may be opened to expose the interior of the housing to allow access to the various components supported therein. Preferably, the panel 110 is latched shut, and the latch used is child-proof to prevent young children from tampering with the apparatus.

The bottom wall of the housing defines a base of the apparatus, and includes a plurality of feet on which the apparatus rests when set on a support surface. Preferably rubber shoes are fitted on the feet to stabilize the apparatus during use.

The front wall of the dispensing apparatus presents an opening 24 through which the pre-moistened towelettes are dispensed, and one or more apertures may be formed in the front and/or side walls for receipt of one or more hand dryer vents, as described below.

A handle is provided on the top wall of the housing for facilitating transport of the apparatus between use locations. Preferably, the handle is retractable from a recess formed in the top wall such that the handle does not protrude from the recess unless retracted for use.

The pre-moistened towelettes are either provided in a stack or wound in a roll, and include a substrate impregnated with a suitable moistening composition, as described above. However, the apparatus illustrated in FIG. 4 is intended primarily for commercial use, and therefore is sized for receipt of a larger stack or roll of towelettes than the embodiment described above.

The towelette support compartment of the apparatus preferably fills substantially the entire interior space of the housing, but may be made smaller by providing a plurality of walls that enclose the compartment as in the embodiment described above. In the illustrated embodiment, the towelettes are stored as a perforated web, and a spindle 112 or the like is provided in the compartment for supporting the towelette roll. One of the walls 110 of the compartment is defined by the hinged panels 110 of the housing such that the compartment is accessible for loading of a fresh roll of towelettes through the panel.

The towelette dispensing assembly 106 functions to restrict manual removal of the web of towelettes from the roll to the dispensing opening 24 at a rate faster than one towelette at a time, and broadly includes a travel limiting mechanism for limiting removal of the web from the storage compartment in incremental lengths greater than one towelette at a time. If desired, the assembly 106 may also include a coin-operated lock that requires coins to be deposited before permitting the removal of towelettes from the apparatus.

The housing 104 includes a second compartment separate from the storage compartment, and the second compartment can be used either as an additional storage compartment for towelettes prior to use, or as a housing for a hand drying assembly 60. If the hand drying assembly is employed, it is powered by the electrical circuit of the apparatus, and an on/off switch is provided on the housing which activates the assembly for a hand drying operation.

The assembly 106 includes an inlet vent 62, an outlet vent 64, a passage 66 connecting the inlet and outlet vents together, a fan 68 for drawing air in the inlet and forcing it from the outlet, and a heating element 70 for warming the air as it travels through the passage. A filter 72 is also provided for filtering the air before it is discharged from the outlet vent. Grills and/or louvers are provided on the vents for safety and for permitting warm air to be discharged in any selected direction, and two or more outlet vents can be connected to the passage to allow multi-directional air discharge, if desired. If the second compartment is not used for receipt of the hand drying assembly, a hinged panel door is fitted over the exterior opening presented by the compartment in the housing. This door provides access to the second compartment so that towelettes can be stored therein until needed.

A paper towel support assembly 74 may also be provided on or in proximity to the housing at any desired location to provide ready access to the user of paper towels that can be used to dry the user's hands after the user has used one of the pre-moistened towelettes. The construction of the paper towel holder is preferably the same as in the previous embodiment. Likewise, a sanitary disposal assembly 82 may be mounted on the housing, or provided separately for permitting disposal of used towelettes.

In order for the user to operate the apparatus, he or she manually pulls on the leading edge of the end-most towelette protruding from the dispensing opening of the apparatus. Removal of the towelette actuates the travel limiting mechanism of assembly 106 such that only a single towelette can be removed from the dispenser before the web is braked in a conventional fashion. As such, it is not possible to pull two or more towelettes from the apparatus in a single pull. Preferably, a timing mechanism is provided in the housing for resetting the travel limiting mechanism after a predetermined delay such that a subsequent towelette can be withdrawn subsequent to the delay.

The towelette is used to cleanse the hands, face, etc. of the user, and is discarded. Thereafter, the user activates the hand drying assembly or takes a paper towel from the roll, if provided, and dries his or her hands.

As with the embodiment described above, it is possible to construct the apparatus such that it includes a towelette warming assembly as described above. Also, the apparatus can be constructed such that it is used to dispense towelettes that are stored dry, and are pre-moistened when they are dispensed. In accordance with this embodiment, a wetting assembly 114, shown in broken line in FIG. 4, is provided in the housing which includes a wetting mechanism and a reservoir for storing the moistening composition. The wetting mechanism can include mechanically or electrically actuated rollers, sprayers or the like, and is connected to a reservoir such that moistening liquid is transferred to the end-most towelette as the towelette is conveyed toward the aperture.

The verification assembly 108 is a means for sensing usage of the apparatus so that an employer can monitor how often employees use the apparatus. In order to achieve such monitoring, badges are provided which are worn by the employees, and a sensor 100 is mounted on or near the apparatus which is capable of detecting the presence of the badge in the vicinity of the apparatus at the time dispensing. Preferably, a switch is provided in association with the travel limiting mechanism such that each time a towelette is withdrawn from the apparatus, a signal is generated that activates the sensor 100 to sense for a badge in proximity thereto. By sensing for a badge each time a towelette is withdrawn, and by recording or saving such information in a conventional manner, it is possible to monitor how often a person wearing a particular badge has activated the apparatus. Such information can be used to reward responsible hand cleansing, and to encourage infrequent users to improve their habits. Likewise, it can be used to implement programs of behavior modification for sustaining a high frequency of hand cleansing, and to enable cooperation with public health agencies to insure public safety.

Figure 5:
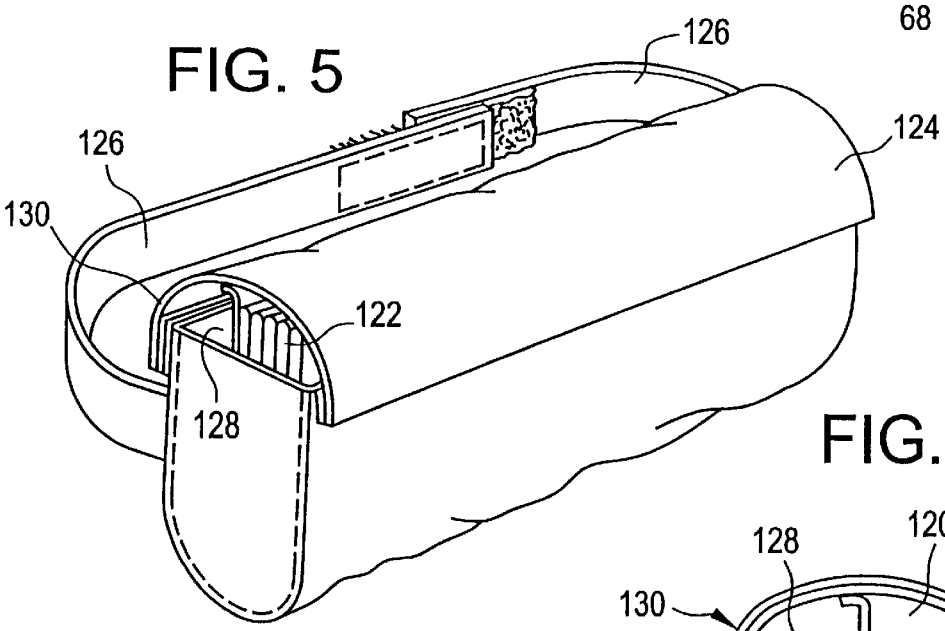
FIG. 5 is a perspective view of a third dispensing apparatus constructed in accordance with the preferred embodiment.
Figure 6:
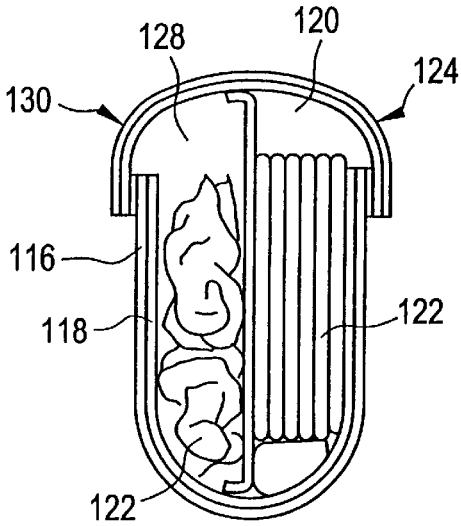
FIG. 6 is a sectional view of the third dispensing apparatus.

A third embodiment of the present invention is shown in FIG. 5, and includes a portable dispenser apparatus capable of being carried by or with a user. The apparatus is an insulated, expandable, easily refilled travel bag or fanny pack for pre-moistened towelettes, and broadly includes a durable, reflective outer layer 116, shown in FIG. 6, covering a heavy-duty, water-resistant inner fabric layer 118. The outer layer 116 is designed to present an easy-to-clean surface that can be cleaned and sanitized by a pre-moistened towelette, while the inner layer 118 serves the function of retaining the moistening composition in the towelettes during storage.

The bag is made of any desirable size and shape, ranging from a very small bag sized for receipt on the wrist of the user, to a very large bag for back pack that permits portable, outdoor access to a large number of towelettes for picnics or camping. The bag includes a first expandable compartment 120 sized for receipt of a stack of separated, individual pre-moistened towelettes 122. A cover 124 is provided for the compartment, and is secured over the opening in the compartment by hook-and-loop fastening strips or the like. Preferably, the strip of material provided on either the cover or the bag is elongated to allow the cover to be closed and secured over the compartment both when the compartment is fully expanded and when it is almost empty.

A pair of non-abrasive removable straps 126 having cooperative hook-and-loop fastening material attached thereto are connected to the ends of the bag for permitting attachment of the bag to a purse, brief case, stroller, back pack, wrist, belt loop, or at a convenient location within a vehicle, home, locker or the like. A pressure clip of conventional construction can also be provided for facilitating attachment and removal of the straps. As such, the apparatus is intended for use as a portable, convenient means of dispensing pre-moistened towelettes in any of a multitude of locations.

A second compartment 128 is provided in the bag that is generally coextensive with the first compartment. The apparatus also includes a separate cover 130 for the second compartment, and hook-and-loop fastening strips are secured to the cover and the bag for permitting the second compartment to be removably covered. The second compartment may either be used as additional storage space for the towelettes, or as a disposal compartment in which used towelettes may be stored until final disposal of the towelettes is possible.

In use, a towelette is removed from the compartment by lifting the cover and removing a single towelette from the stack stored therein. Once cleaning is completed, the towelette can then be disposed of by lifting the cover and placing the towelette in the compartment. After the user arrives at a destination having a trash can or the like, the used towelette is removed from the compartment and deposited therein.

Although the invention has been described with reference to the preferred embodiment illustrated in the attached drawing, it is noted that substitutions may be made and equivalents employed herein without departing from the scope of the invention as recited in the claims. For example, although the apparatuses shown in FIGS. 1–4 are illustrated as being self-supported, it is possible to provide any conventional type of mounting bracket for supporting the apparatuses on a wall or beneath a counter top or table.

What is claimed is:

1. A portable dispenser apparatus for dispensing pre-moistened towelettes from a web roll, comprising:

a housing formed with a towelette dispensing opening, and a storage compartment adapted to support the web of pre-moistened towelettes in a roll;

a dispensing means for drawing an end-most towelette from the web and dispensing it through the dispensing opening;

an activating means for activating the dispensing means to dispense the end-most towelettes from the web, the activating means including an actuator that momentarily actuates the activating means when operated to dispense a single towelette; and a removal sensing means for sensing removal of the end-most towelette of the web from the dispensing opening and providing a control signal, the dispensing means being responsive to the control signal to return the remainder of the web to the storage compartment subsequent to removal of the end-most towelette from the dispensing opening.

2. The dispenser apparatus as recited in claim 1, wherein the housing is formed of a heat insulative material.

3. The dispenser apparatus as recited in claim 1, further comprising a warming means for warming the end-most towelette during operation of the dispensing means.

4. The dispenser apparatus as recited in claim 1, further comprising a disposal means for receiving used towelettes.

5. The dispenser apparatus as recited in claim 4, wherein the disposal means includes a compartment with an open top end, and a disposal bag suspended in the compartment so that towelettes can be deposited into the bag through the open top end of the compartment.

6. The dispenser apparatus as recited in claim 5, further comprising a means for storing additional disposal bags.

7. The dispenser apparatus as recited in claim 5, wherein the disposal means includes a cover for closing the open top end of the compartment.

8. The dispenser apparatus as recited in claim 5, wherein the compartment includes an upper edge that supports the disposal bag while permitting the bag to be removed for emptying.

9. The dispenser apparatus as recited in claim 1, further comprising a hand drying assembly including an air inlet, an air outlet, a fan for moving air from the inlet to the outlet, an air filter through which the air is forced, and a warming means for warming the air as it is moved from the inlet toward the outlet.

10. The dispenser apparatus as recited in claim 9, wherein two air outlets are provided.

11. The dispenser apparatus as recited in claim 1, further comprising a means for indicating the size of the roll in the storage compartment as an indication of the number of towelettes remaining to be dispensed.

12. The dispenser apparatus as recited in claim 1, further comprising a paper towel holder supported on the housing.

13. The dispenser apparatus as recited in claim 12, further comprising a stabilizing means for stabilizing the removal of paper towels from the holder.

14. The dispenser apparatus as recited in claim 12, further comprising a sensor responsive to the removal sensing means for detecting the identity of the user of the apparatus.

15. The dispenser apparatus as recited in claim 1, wherein the dispensing means includes a motor, the apparatus further comprising a power cord for supplying power to the motor, and a means for retracting the power cord to prevent the formation of slack in the cord.

* * * * *